US006571969B2

(12) United States Patent
Larbaletier

(10) Patent No.: US 6,571,969 B2
(45) Date of Patent: Jun. 3, 2003

(54) MERCHANDISE DISPLAY CASE

(75) Inventor: Robert Larbaletier, Fontaine les Gres (FR)

(73) Assignee: Larbaletier S.A., Fontaine les Gres (FR)

( * ) Notice: Subject to any disclaimer, the term of this patent is extended or adjusted under 35 U.S.C. 154(b) by 0 days.

(21) Appl. No.: 09/891,869

(22) Filed: Jun. 26, 2001

(65) Prior Publication Data

US 2002/0023889 A1 Feb. 28, 2002

(30) Foreign Application Priority Data

Jun. 27, 2000 (FR) ..... 00 08257

(51) Int. Cl.[7] ..... A47F 5/10

(52) U.S. Cl. ..... 211/150; 108/92; 108/106; 108/147.2

(58) Field of Search ..... 211/150, 149; 108/102, 106, 147.11, 147.2, 92

(56) References Cited

U.S. PATENT DOCUMENTS 5,590,796 A * 1/1997 Herman ..... 211/149

D383,336 S * 9/1997 Van Der Merwe et al. .. D6/474

FOREIGN PATENT DOCUMENTS

| | | |
|---|---|---|
| EP | 0 560 022 | 9/1993 |
| FR | 624 114 A | 7/1927 |
| FR | 656 756 A | 5/1929 |
| JP | 2-45515 | 4/1990 |
| WO | WO 98 09556 | 3/1998 |

* cited by examiner

*Primary Examiner*—Daniel P. Stodola
*Assistant Examiner*—Erica B Harris
(74) *Attorney, Agent, or Firm*—Lowe Hauptman Gilman & Berner, LLP

(57) ABSTRACT

A merchandise display case has several trays, each installed to pivot freely about first hinge pins at two opposite sides on uprights to form a deformable parallelepiped with these uprights. Second pivot hinge pins mount the uprights on a frame. The second hinge pins of at least one pair of articulated uprights at opposite ends close to the same longitudinal side of the trays are fixed to a structure that can slide vertically with respect to the frame.

9 Claims, 6 Drawing Sheets

FIG 1A
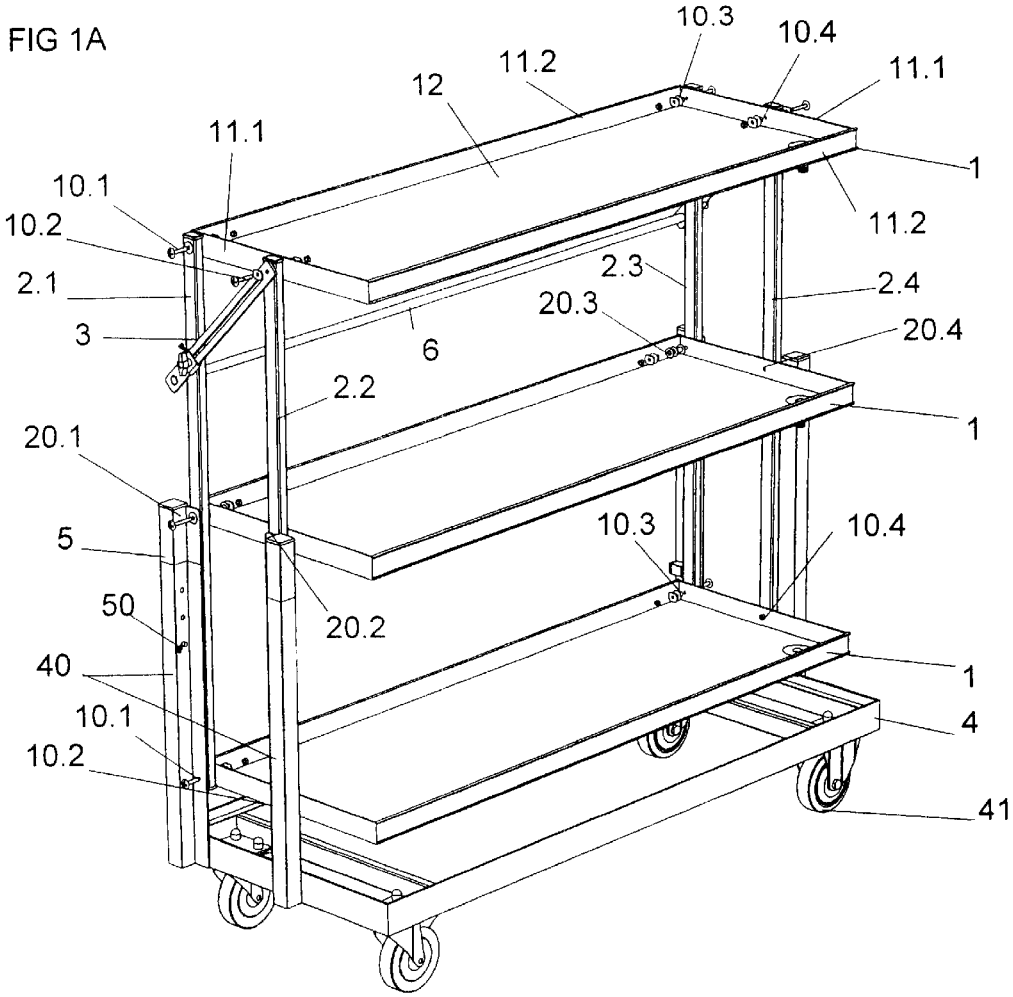
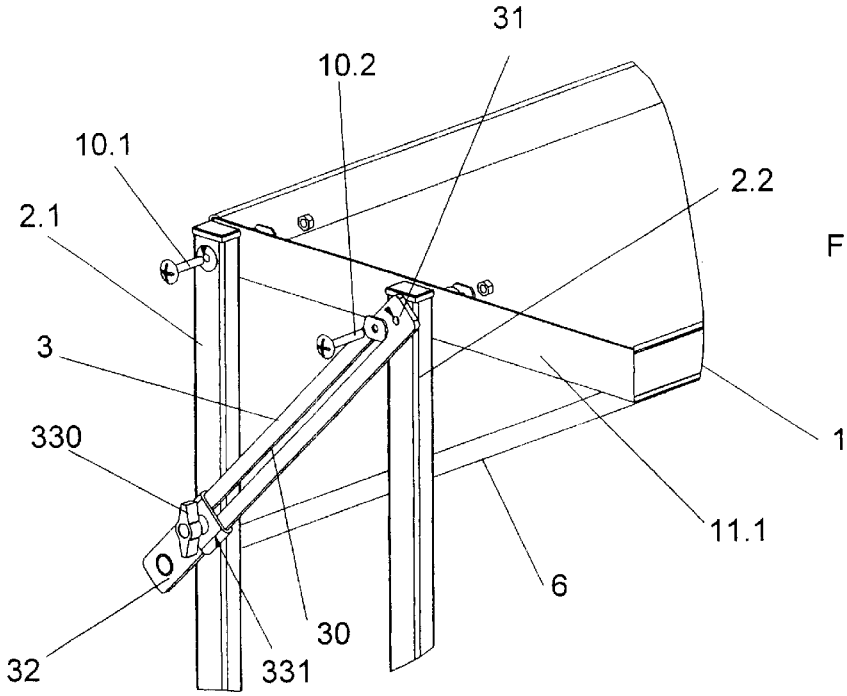
FIG 3

FIG 2A
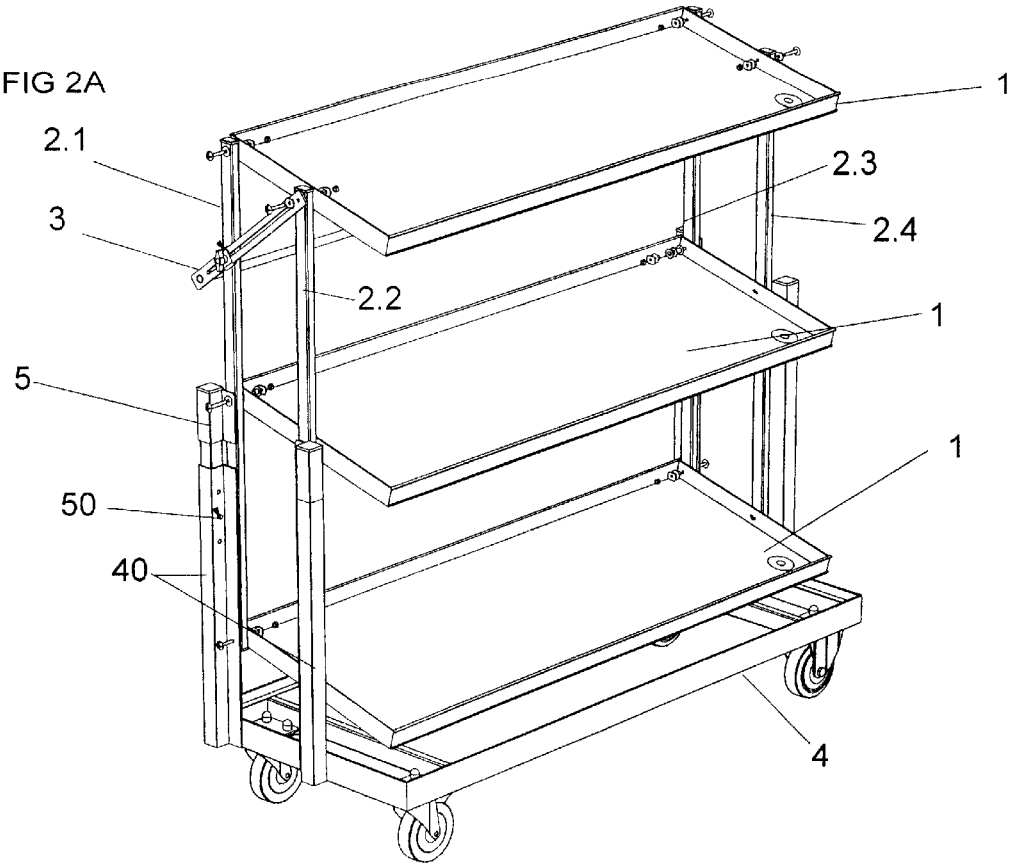
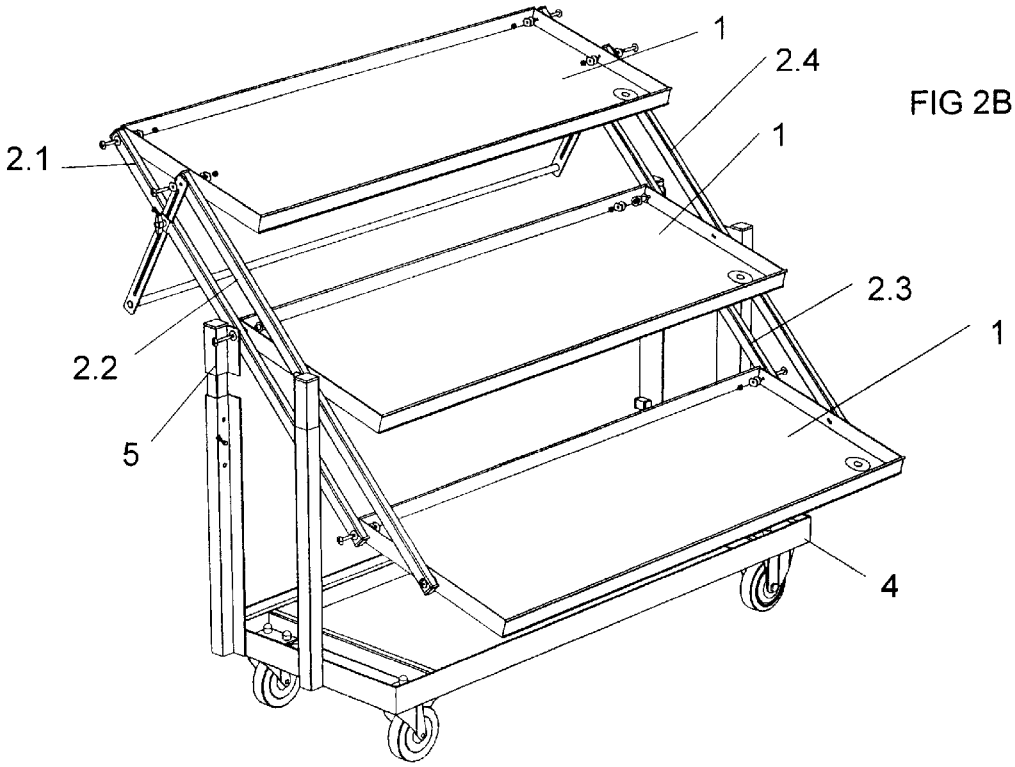
FIG 2B

MERCHANDISE DISPLAY CASE

This invention relates to a merchandise display case with several trays mounted articulated to a frame possibly fitted with rollers.

In prior art, European patent EP 560 022 divulges a merchandise display case comprising several horizontal trays. The trays are installed articulated on uprights to form several deformable parallelograms also installed articulated on a frame with rollers. The articulations of the trays on the uprights and of the uprights on the frame are used to tilt the trays from a position in which they are vertically superposed into a position in which they are aligned in the same horizontal plane. When changing from one position to another, the trays remain horizontal. Thus, the display case described in patent EP 560 022 does not include any device for modifying the inclination of the trays. For example, this has the disadvantage that it makes it difficult to see merchandise displayed on the end trays.

Therefore, this invention is intended to overcome the disadvantages of prior art by proposing a merchandise display case in which the inclination of the trays can be modified.

This objective is achieved by a merchandise display case comprising several trays, each tray being installed free to pivot about its first hinge pin at two opposite sides on uprights to form a deformable parallelepiped with these uprights, the uprights being installed on a frame through second hinge pins, characterized in that there is at least one pair of articulated uprights at opposite ends close to the same longitudinal side of the trays is free to pivot about second hinge pins that are fixed to means sliding vertically relative to them on the frame.

Figure 1B:
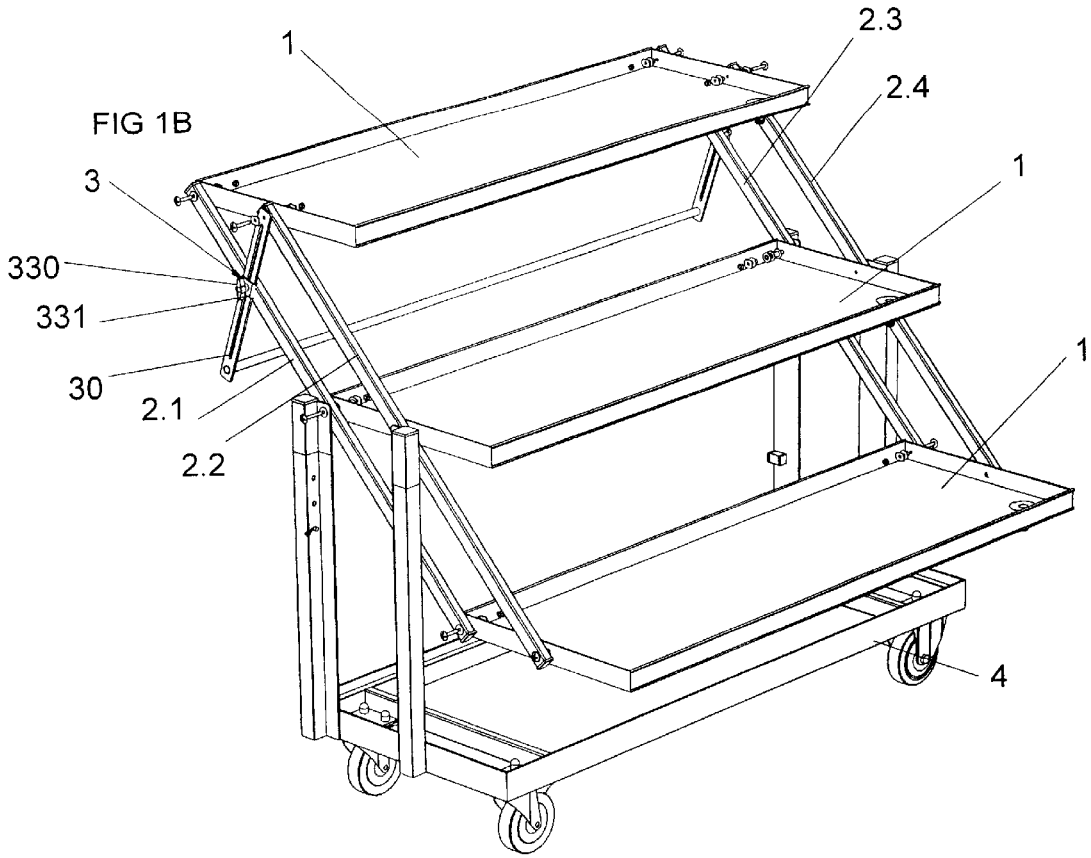
Figure 1C:
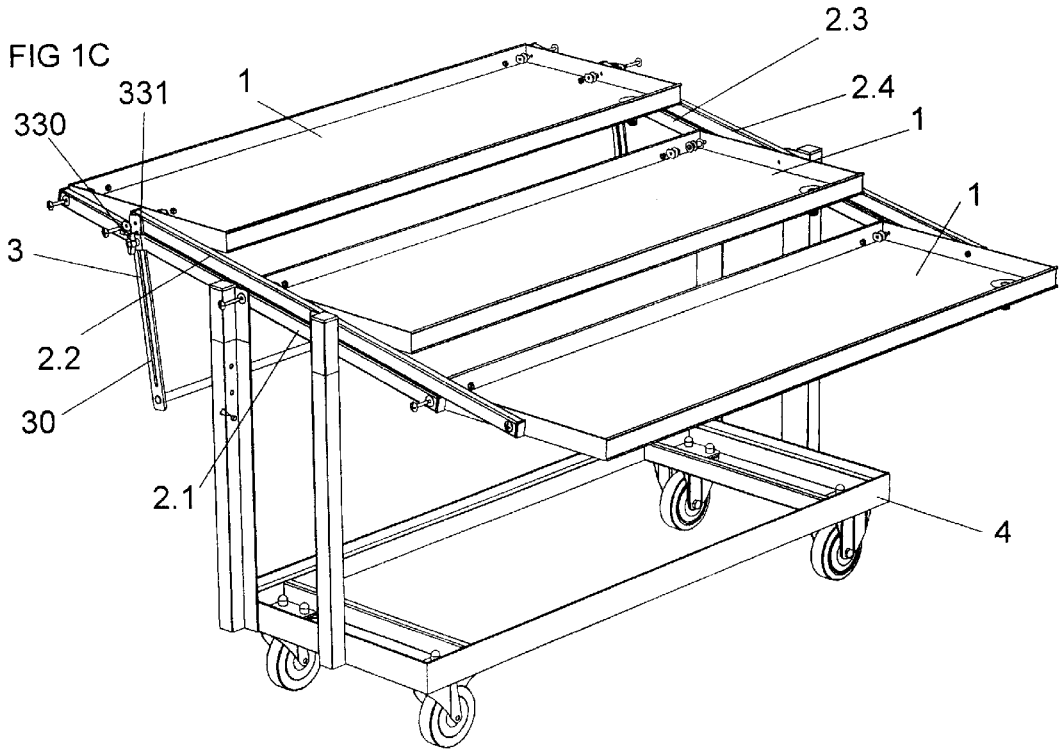
Figure 2C:
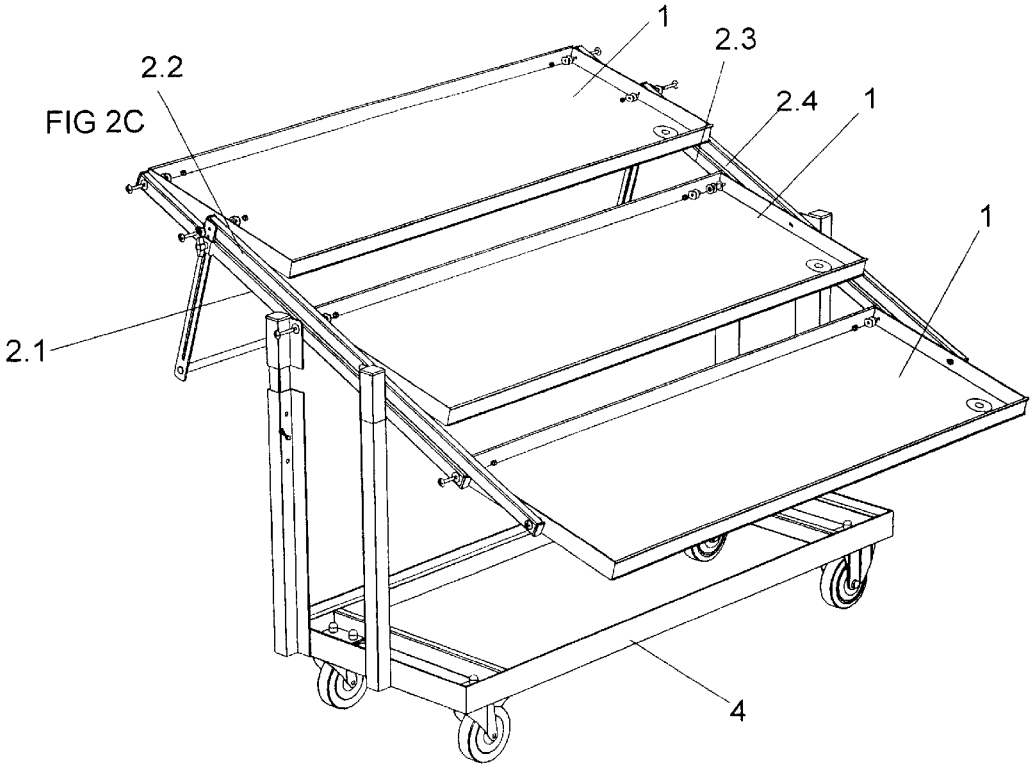
Figure 4:
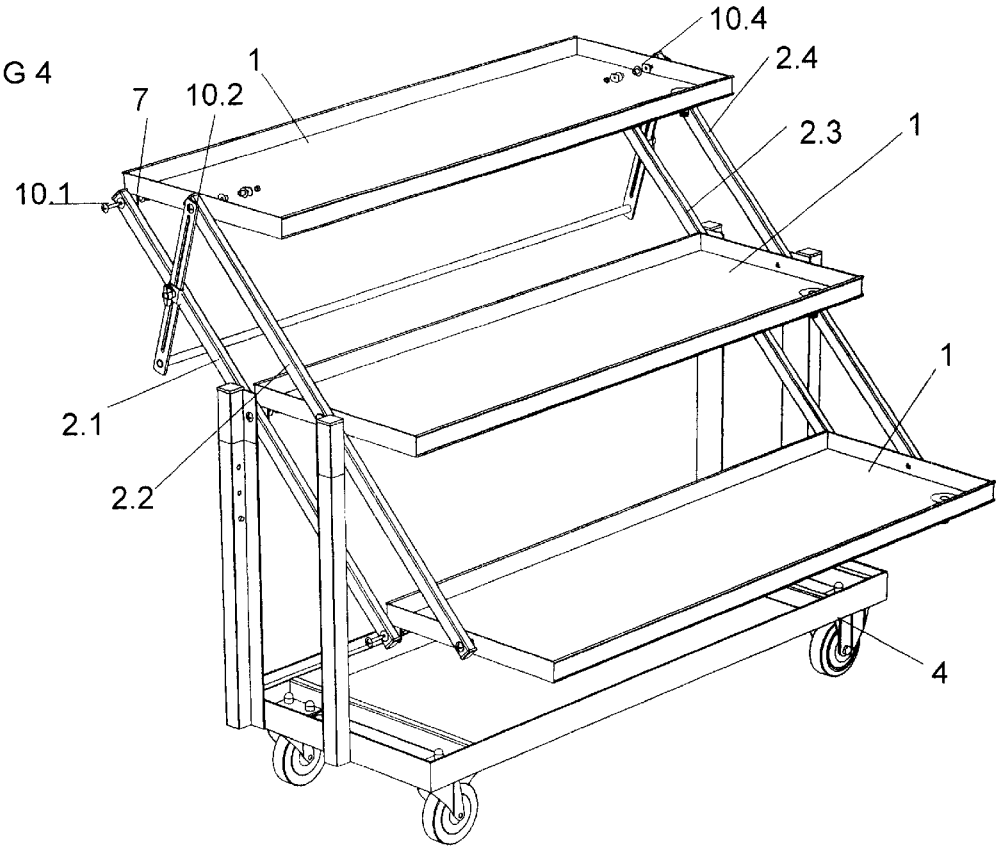
Figure 5:
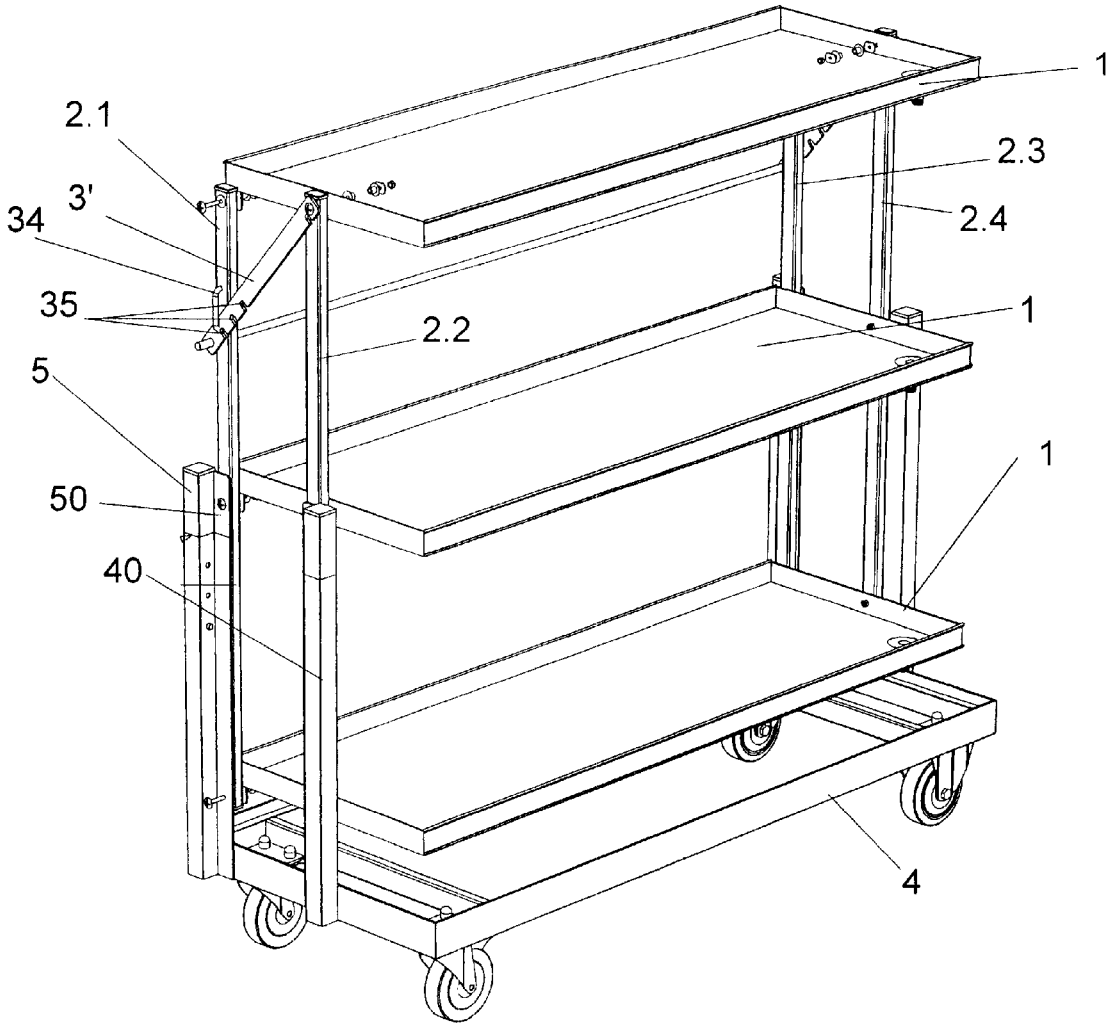

The invention and its characteristics and advantages will be more clearly understood after reading the description made with reference to the attached drawings in which:

FIGS. 1A to 1C are perspective views of a first variant embodiment of the display case in three different pivoting positions of the trays when the trays are horizontal, FIGS. 2A to 2C are perspective views of the first variant embodiment of the display case in three different pivoting positions of the trays when the trays are inclined with respect to a horizontal plane, FIG. 3 is a detailed view of the assembly of uprights on a tray, FIG. 4 is a perspective view of a second variant embodiment of the display case in a partial pivoted position of the trays when the trays are horizontal, FIG. 5 is a perspective view of a second variant embodiment of the display case, means of the uprights on the trays.

Figure 6:
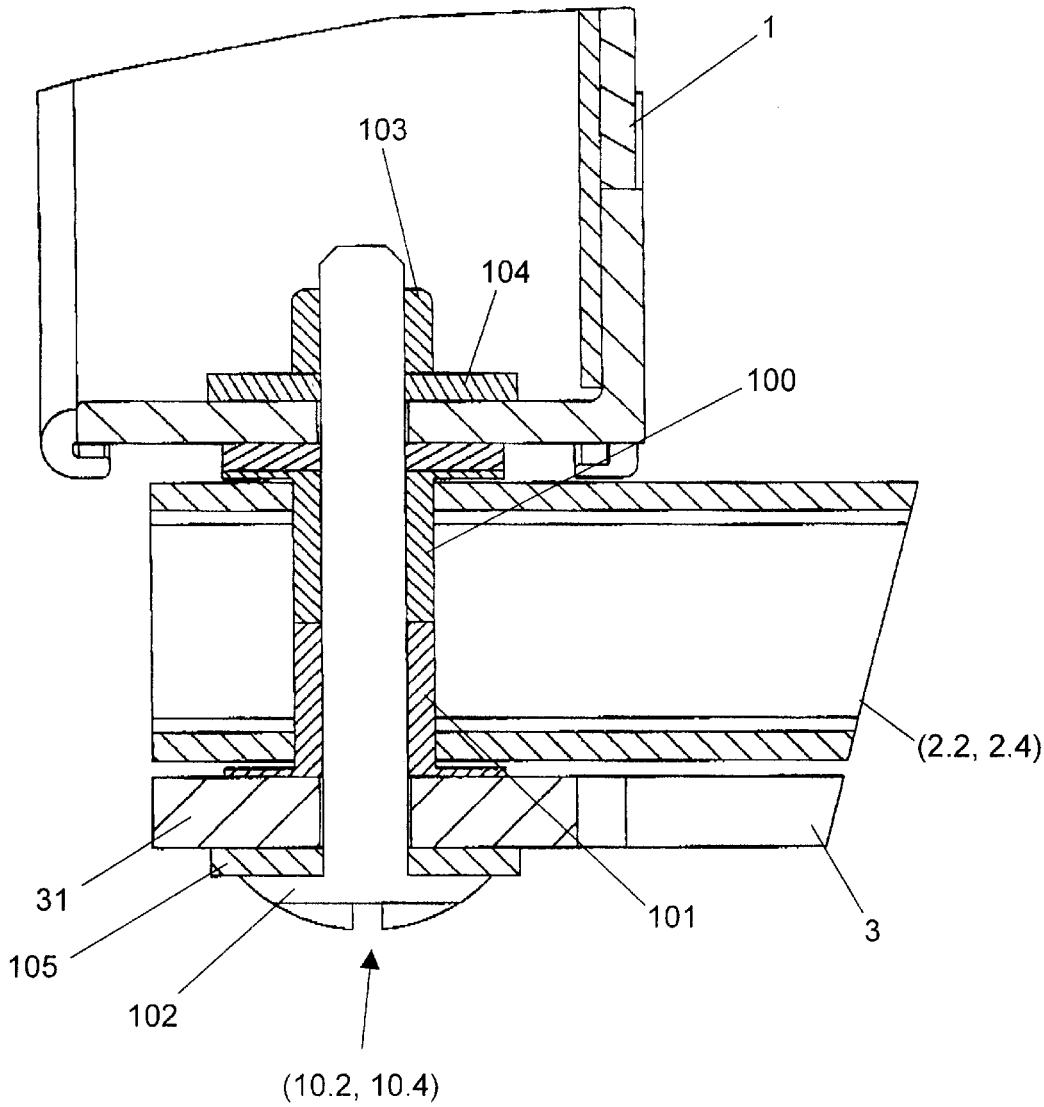

FIG. 6 is a sectional view of the pivoting and mounting means of the uprights on the trays.

The display case according to the invention will now be described with reference to FIGS. 1A and 3. The display case comprises essentially a frame 4 used for the assembly of a pair of uprights 2.1 to 2.4, forming a parallelogram with each side of the trays 1, these uprights will support several trays 1 hinged on these uprights to form surfaces for supporting and presenting merchandise. The frame 4 is formed of a frame on opposite sides of which the four vertical arms 40 are installed. For example, the frame 4 is mounted on rollers 41 to facilitate displacement of the display case.

Each tray 1 is formed of a bottom 12, for example with a rectangular shape, the sides of which comprise edges 11.1, 11.2 perpendicular to the bottom 12. Each tray 1 has at least two edges 11.1 or opposite sides free to pivot on the uprights

2.1 to 2.4. The pivoting link between an upright 2.1 to 2.4 and the edge 11.1 or side of a tray 1 is made by means of a first hinge pin 10.1 to 10.4 passing through the upright 2.1 to 2.4 and the edge 11.1 of the corresponding tray 1. Thus, each side of a tray 1 is hinged with respect to the two uprights 2.1 to 2.4. According to a first variant embodiment, the first hinge pins 10.1 10.2 or 10.3 10.4 of each edge 11.1 of each tray 1 are included in a plane parallel to the plane of the tray 1. In other words, the first hinge pins (10.1, 10.2 or 10.3 10.4) of one edge 11.1 of the tray 1 are all on the straight line parallel to the top and bottom edges of the corresponding edge 11.1 of the tray 1.

According to FIGS. 3 and 6, the first hinge pins 10.1 to 10.4 are equipped, for example, with strutted washers. The first hinge pins 10.1 to 10.4 comprise a strut in two parts 100 101 going through each upright 2.1 to 2.4, on either sides, and fixed on each tray 1 with a screw 102, a nut 103 and washers 104 105.

The pivoting assembly of an upright 2.1 to 2.4 on the frame 4 is made by means of a second hinge pin 20.1 to 20.4. According to the invention, the frame 4 comprises at least one pair of uprights (2.1, 2.2 or 2.3, 2.4) mounted on the opposite edges 11.1 of each tray 1. The second hinge pins 20.1 to 20.4 of the uprights (2.1, 2.2, or 2.3, 2.4) are fixed on the slide means 5 vertically adjustable with respect to the vertical arms 40 of the frame 4, to articulate the deformable parallelogram in rotation between two extreme positions, one of which is approximately vertical and the other approximately horizontal. For example, the sliding means include arms 5 sliding in the vertical arms 40 of the frame 4.

According to the variant embodiments shown in FIGS. 1 to 4, the second hinge pins 20.1 to 20.4 can also correspond to the first hinge pins of one of the intermediate trays 1. sliding of the arms 5 may be blocked in a position determined by the locking means 50. These locking means comprise several drillings 50 passing firstly through the vertical arms 40 forming a stand and secondly the arm 5, and finally a split pin with a diameter approximately equal to the diameter of the drillings 50. An arm 5 is blocked in position by aligning a drilling in arm 5 on one side with a drilling in the stand 40 on the same side, and then by inserting the split pin along the line of the two drillings. Other systems for fixing the position could also be used without going outside the scope of the invention.

According to FIGS. 1A to 1Cc, the position chosen for the sliding arms 5 is such that all trays are horizontal.

According to FIGS. 2A to 2C, the position chosen for the sliding arms 5 is such that the upright hinged on a vertical arm 40 is vertically offset from the arm 5 hinged on a vertical arm located on the same side of the frame 4 such that all trays 1 are inclined with the front edge 11.2 lower than the back edge 11.2.

According to the invention, a first pair of uprights 2.1, 2.3 for each tray 1 is installed approximately at the first end of the opposite edges 11.1 and the second pair of uprights 2.2, 2.4 is installed at a given nonzero distance from the second end of the opposite edges 11.1. With this configuration, the arm 5 can be slid to obtain a given inclination. Thus, the geometry of the display case and the mechanical strength of the trays 1 are only slightly different for two different inclinations. In other words, for the same displacement of the arms 5, the inclination of the trays 1 is lower when the distance between the attachment points of the uprights 2.1 to 2.4 on each edge 11.1 increases.

For example, the given distance between the attachment points of the two uprights (2.1, 2.2 or 2.3, 2.4) is equal to approximately half the length of each edge 11.1 on which the uprights (2.1, 2.2 or 2.3, 2.4) are installed. In this configuration, a satisfactory compromise is achieved between the possible angle of inclination of the trays 1 and the mechanical strength of the display case regardless of the pivot position and the inclination of the trays 1.

The first and second hinge pins 10.1 to 10.4, 20.1 to 20.4 are then used to pivot the uprights 2.1 to 2.4 while keeping the inclination of the trays 1 constant.

In order to keep the uprights 2.1 to 2.4 in a position chosen by the user, the display case according to the invention comprises means 3 for blocking the uprights 2.1 to 2.4 to prevent them from pivoting. These blocking means comprise an arm 3 making a link between the uprights (2.1, 2.2 or 2.3, 2.4) installed on the same edge 11.1. This arm 3 comprises locking means 30 for keeping the distance between the two uprights constant. Thus the uprights can no longer pivot when these locking means 30 are activated.

The locking means comprise a groove 30 formed along the longitudinal axis of a locking arm 3 and a fixed axis on an upright 2.1 or 2.3 sliding in the groove 30. A first end 31 of the locking arm 3 is fixed free to pivot on the second upright 2.2 or 2.4, for instance by means of the mounting and pivoting screw 102 of the upright 2.2 2.4 on the tray, this screw 102 going through this first end 31 of the locking arm 3, as shown in FIGS. 3 and 6. In the variant embodiment shown, the pivot axis of the locking arm 3 on the second upright 2.2 or 2.4 is coincident with the first hinge pin 10.2 or 10.4 on the tray 1. Thus, in the unlocked position, the uprights 2.1 to 2.4 are free to pivot since firstly the fixed hinge pin is free to slide and rotate in the groove 30, and secondly the first end 31 of the locking arm 3 is free to pivot with respect to the upright. Consequently, the distance between two uprights (2.1, 2.2 and 2.3, 2.4) can vary freely.

The sliding movement of the hinge pin in the groove 30 can be locked, by means of a knurled knob 330 and a clamping ring 331 will be installed for example on a thread of the hinge pin. Thus, all that is necessary to lock the position of the locking arm 3 is to tighten the knurled knob 330. This then blocks the locking arm 3 in translation and in rotation between the clamping ring 331 and the upright 2.1 or 2.3. In this case, the distance between the two uprights (2.1, 2.2 or 2.3, 2.4) is fixed and it is no longer possible to pivot.

The second ends 32 of the locking arms 3 are connected by a cross piece 6 to increase the stiffness of the display case according to the invention.

Other locking systems could be chosen to keep the distance between the uprights (2.1, 2.2 or 2.3, 2.4) constant, to prevent them from pivoting. Thus, in a variant embodiment shown in FIG. 5, the locking means comprise a stirrup 34 fixed onto a pair of first uprights 2.1, 2.3 close to one longitudinal side 11.2 of the trays, and an arm 3', one end of which is hinged to a second upright 2.2, 2.4. The arm 3' comprises notches 35 in which the stirrup is housed as a function of the deployment position of the chosen uprights.

In another variant embodiment (not shown), the locking means comprise a plate fixed to an upright, for example at an intermediate tray. The plate comprises locking means cooperating with complementary locking means fitted on the tray. For example, the locking means comprise notches into which a stud free to move in translation is installed on the side of the intermediate tray. In another variant, the plate is provided with a groove forming an arc of a circle inside which a hinge pin fixed to the side of the tray is free to slide. The movement of the hinge pin can be locked by a knurled knob installed on the side of the tray. For example, these two variant embodiments are shown in the Japanese utility model 4-4827.

FIGS. 1A and 2A show the display case according to the invention when the uprights 2.1 to 2.4 are vertical. In this position, the trays 1 are positioned one above the other. All that is necessary to change from the position shown in FIGS. 1A and 2A to the position shown in FIGS. 1B and 2B is to loosen the knurled knobs 330 and then tilt the uprights 2.1 to 2.4 into the chosen position and finally to tighten the knurled knobs 330 again. In the position shown in FIGS. 1B and 2B, the uprights 2.1 to 2.4 have pivoted by about 450, 30 that the trays 1 can be offset with respect to each other.

The figures show the display case according to the invention when the uprights 2.1 to 2.4 have pivoted to the maximum value. In this position, the pairs of uprights 2.1 to 2.4 mounted on each opposite edge 11.1 are coincident, but the trays 1 are slightly offset from each other vertically.

FIG. 4 shows a second variant embodiment of the display case. This second variant embodiment is identical with the first variant embodiment shown in FIGS. 1A to 1C and 2A to 2C in all respects, apart from the assembly of the uprights 2.1 to 2.4 on trays 1. In this second variant, the first hinge pins (10.1, 10.2 or 10.3 and 10.4) of each pair of opposite edges 11.1 of each tray 1 are offset in the two planes parallel to the bottom of the tray 1. Thus, one of the two hinge pins 10.2 or 10.4 is articulated above the bottom on the edge 11.1 of the tray, whereas the other first hinge pin 10.1 or 10.3 is articulated below the bottom of the tray 1 on an attachment bracket 7 fixed under the bottom 12 of the tray 1. The offset of the hinge pins (10.1 and 10.2 or 10.3 and 10.4) means that the trays 1 can all be placed in the same horizontal plane when the uprights 2.1 to 2.4 are pivoted to their maximum. Furthermore, if one of the second hinge pins 20.1, 20.3 of each pair located on each side 11.1 of the tray 1 and close to the same longitudinal side 11.2 is vertically offset from the other second hinge pin 20.2, 20.4 located on the same side 11.1, then the plane of the trays 1 may form a non-zero angle with the horizontal as a function of the sliding of the sliding arm 5.

Thus, the merchandise display case according to the invention is characterized in that the second hinge pins 20.1 to 20.4 about which at least one pair of uprights 2.1, 2.2 and/or 2.3, 2.4 are free to pivot, hinged on opposite sides and close to the same longitudinal side 11.2 of the trays 1, are fixed to means 5 free to slide vertically with respect to the frame 4.

In another embodiment, one of the first hinge pins 10.1, 10.3 is located close to a first end of the edge 11.1 of the tray 1 close to one longitudinal side 11.2 of the trays 1, for each side of the tray 1 comprising the first hinge pins 10.1 to 10.4, and the other first hinge pin 10.2, 10.4 is mounted at a fixed non-zero distance from the second end of the edge 11.1 of the tray.

In another embodiment, the given distance at which the other first hinge pin 10.2, 10.4 is installed is equal to approximately half the length of the edge 11.1 of the tray 1.

In another embodiment, for each side of the tray 1, the first hinge pins 10.1 to 10.4 used to assemble the uprights 2.1 to 2.4 are contained in the same plane parallel to the plane of the tray 1.

In another embodiment, for each side of the tray 1, the first hinge pins 10.1 to 10.4 used for assembly of the uprights 2.1 to 2.4 are offset parallel to the plane of the bottom of the tray 1 such that in the position of maximum rotation, all trays are included in the same plane.

In another embodiment, the display case comprises a locking arm 3 in the pivoting position of the uprights 2.1 to 2.4, of which a first end 31 is mounted free to pivot on a first upright 2.2, 2.4, the locking arm 3 comprises a longitudinal groove 30 in which a locking pin fixed to the second upright 2.1, 2.3 is free to slide, the locking axis comprising means 330, 331 of locking the locking arm 5 in translation and in rotation.

In another embodiment, the display case comprises a locking arm 3' in the pivot position of the uprights 2.1 to 2.4, one end 31 of which is free to pivot on a first upright 2.2, 2.4 on one side edge 11.1 of the tray 1, and the locking arm 3 comprises notches 35 in which a stirrup 34 is fixed to the second upright 2.1, 2.3 of the same side 11.1.

In another embodiment, the display case comprises a locking plate fixed to a first upright 2.1, 2.3 and means for locking a hinge pin installed on the tray 1 located close to the plate.

In another embodiment, the vertically sliding means comprise an arm 5 on each side 11.1, free to slide in a stand 40 of the frame close to the same longitudinal side 11.2 of the tray 1, a first end of the arm containing a housing for the assembly of the second hinge pin 20.1 to 20.4 of an upright 2.1 to 2.4, the arm 5 comprising means 50 preventing movement in translation with respect to the frame 4.

In another embodiment, one of the first hinge pins 10.1, 10.3 of the tray is articulated on an attachment bracket 7 fixed under the bottom 12 of the tray 1, the other first hinge pin 10.2, 10.4 being articulated on the edge of the tray 1 in a plane parallel to the bottom 12.

Persons with experience in this subject will find it obvious that this invention could be used for embodiments in many other specific forms without going outside the scope of the invention as claimed. Consequently, these embodiments must be considered as illustrations that can be modified within the scope defined by the attached claims.

What is claimed is:

1. Merchandise display case comprising a frame; a structure mounted on said frame and capable of sliding vertically with respect to said frame; and a plurality of trays, each tray being installed to pivot freely about hinge pins at first and second opposite sides of the tray on uprights to form a deformable parallelepiped with said uprights, the uprights being installed on said structure through said hinge pins that mount a central tray to said uprights, hinge pins of said central tray of at least one pair of said uprights being in proximity to the first and second opposite sides and close to one longitudinal side of the tray, wherein the longitudinal side is between the first and second opposite sides.

2. Merchandise display case according to claim 1, wherein, on each side of each of said trays one of the hinge pins is located close to the one longitudinal side of the trays, one of the hinge pins being mounted at a fixed, non-zero distance from the second opposite side of the tray.

3. Merchandise display case according to claim 2, wherein the distance at which said one of the hinge pins is installed is a location approximately half way along the length of the side of the tray.

4. Merchandise display case according to claim 1, wherein, for each of the first and second opposite sides of the tray, the hinge pins used to connect the tray to the uprights are located in the same plane parallel to the plane of the tray.

5. Merchandise display case according to claim 1, wherein, for each side of the tray, the hinge pins used for connecting the tray to the uprights are offset parallel to the plane of the bottom of the tray such that in a position of maximum rotation, all trays are located in the same plane.

6. Merchandise display case according to claim 1, wherein the display case comprises a locking arm which in a pivoting position of the uprights, has a first end mounted to pivot freely on a first of the uprights, the locking arm comprises a longitudinal groove in which a locking pin fixed to a second of the uprights is free to slide, the locking pin comprising a lock for locking the locking arm in translation and in rotation.

7. Merchandise display case according to claim 1, wherein the display case comprises a locking arm, which in a pivot position of the uprights, has one end free to pivot on a first upright on one side edge of the tray, and the locking arm comprises notches in which a stirrup, fixed to a second upright of the same side, can be inserted.

8. Merchandise display case according to claim 1, wherein the vertically sliding structure comprises an arm on each of the first and second sides, the arm being free to slide in a stand of the frame close to the same longitudinal side of the tray, a first end of the arm including a housing for an assembly including the arm and the second pivot hinge pin of an upright, the arm comprising a structure for preventing movement in translation with respect to the frame.

9. Merchandise display case according to claim 1, wherein one of the hinge pins of the tray is articulated on an attachment bracket fixed under the bottom of the tray, another of the hinge pins being articulated on an edge of the tray in a plane parallel to the bottom.

* * * * *